US009291164B2

(12) United States Patent
Ahn et al.

(10) Patent No.: US 9,291,164 B2
(45) Date of Patent: Mar. 22, 2016

(54) SCROLL COMPRESSOR HAVING A BUSH BEARING PROVIDED ON A BOSS OF ORBITING SCROLL

(71) Applicant: LG ELECTRONICS INC., Seoul (KR)

(72) Inventors: Sungyong Ahn, Seoul (KR); Seheon Choi, Seoul (KR); Byeongchul Lee, Seoul (KR); Byoungchan Kim, Seoul (KR); Junghoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/293,028

(22) Filed: Jun. 2, 2014

(65) Prior Publication Data

US 2014/0356210 A1 Dec. 4, 2014

(30) Foreign Application Priority Data

Jun. 3, 2013 (KR) ..... 10-2013-0063591

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/02*** | (2006.01) |
| ***F04C 23/00*** | (2006.01) |
| ***F04C 29/00*** | (2006.01) |

(52) U.S. Cl.

CPC ..... *F04C 18/0215* (2013.01); *F04C 23/008* (2013.01); *F04C 29/0057* (2013.01); *F04C 29/0071* (2013.01); *F04C 2230/91* (2013.01); *F04C 2240/56* (2013.01); *F05C 2225/12* (2013.01); *F05C 2251/14* (2013.01)

(58) Field of Classification Search

CPC ..... F04C 18/0215; F04C 23/008; F04C 29/0057; F04C 29/0071; F04C 2230/91; F04C 2240/50; F04C 2240/56; F05C 2225/12; F05C 2251/14

USPC ..... 418/55.1–55.6, 57, 178–179

See application file for complete search history.

(56) References Cited

U.S. PATENT DOCUMENTS

| | | | | |
|---|---|---|---|---|
| 5,568,983 | A * | 10/1996 | Wilson | 384/300 |
| 6,332,716 | B1 * | 12/2001 | Kato et al. | 384/300 |
| 6,461,131 | B2 * | 10/2002 | Chang | 418/55.5 |
| 2002/0015839 | A1 * | 2/2002 | Niwa et al. | 428/325 |

FOREIGN PATENT DOCUMENTS

| | | |
|---|---|---|
| DE | 10 2011 087 821 | 6/2012 |
| EP | 1 803 939 | 7/2007 |
| JP | 2000-27867 | 1/2000 |
| JP | 2003-003970 | 1/2003 |

OTHER PUBLICATIONS

European Search Report dated Oct. 2, 2014. (14170889.1).
Chinese Office Action dated Dec. 24, 2015.

* cited by examiner

*Primary Examiner* — Theresa Trieu
(74) *Attorney, Agent, or Firm* — Ked & Associates LLP

(57) ABSTRACT

A scroll compressor is provided in which a boss of an orbiting scroll is inserted into and coupled to a boss coupling recess of a crank shaft, so that friction loss of a bearing portion of the crank shaft may be reduced, compression efficiency and reliability of the compressor may be enhanced, and noise and material costs may be reduced. A bush bearing may be formed as a coating on the boss of the orbiting scroll, so that a thickness of the bearing portion of the crank shaft may be reduced. Since an outer circumferential surface of the bearing portion is in contact with an inner circumferential surface of the boss coupling recess, damage to the bearing portion may be prevented.

19 Claims, 10 Drawing Sheets

SCROLL COMPRESSOR HAVING A BUSH BEARING PROVIDED ON A BOSS OF ORBITING SCROLL

CROSS-REFERENCE TO RELATED APPLICATION

Pursuant to 35 U.S.C. §119(a), this application claims the benefit of earlier filing date and right of priority to Korean Application No. 10-2013-0063591, filed on Jun. 3, 2013, the contents of which is incorporated by reference herein in its entirety.

BACKGROUND

1. Field

This relates to a scroll compressor.

2. Background

A scroll compressor may include a fixed scroll fixed in an inner space of a container, and an orbiting scroll engaged with the fixed scroll and performing an orbiting movement forming a pair of compression chambers that continuously move between a fixed wrap of the fixed scroll and an orbiting wrap of the orbiting scroll. Scroll compressors may smoothly performs suctioning, compressing, and discharging operations on refrigerant to obtain stable torque, while achieving a relatively high compression ratio compared to other types of compressor, may be used for compressing refrigerant in, for example, air-conditioning devices, and the like. Scroll compressors may include a fixed radius type scroll compressor in which the orbiting scroll rotates in the same track all the time, regardless of changes in compression conditions, and a variable radius type scroll compressor in which the orbiting scroll may retreat in a radial direction based on compression conditions.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of the exemplary embodiments, with reference to the accompanying drawings.

For the sake of brief description with reference to the drawings, the same or equivalent components will be provided with the same reference numbers, and description thereof will not be repeated.

Figure 1:
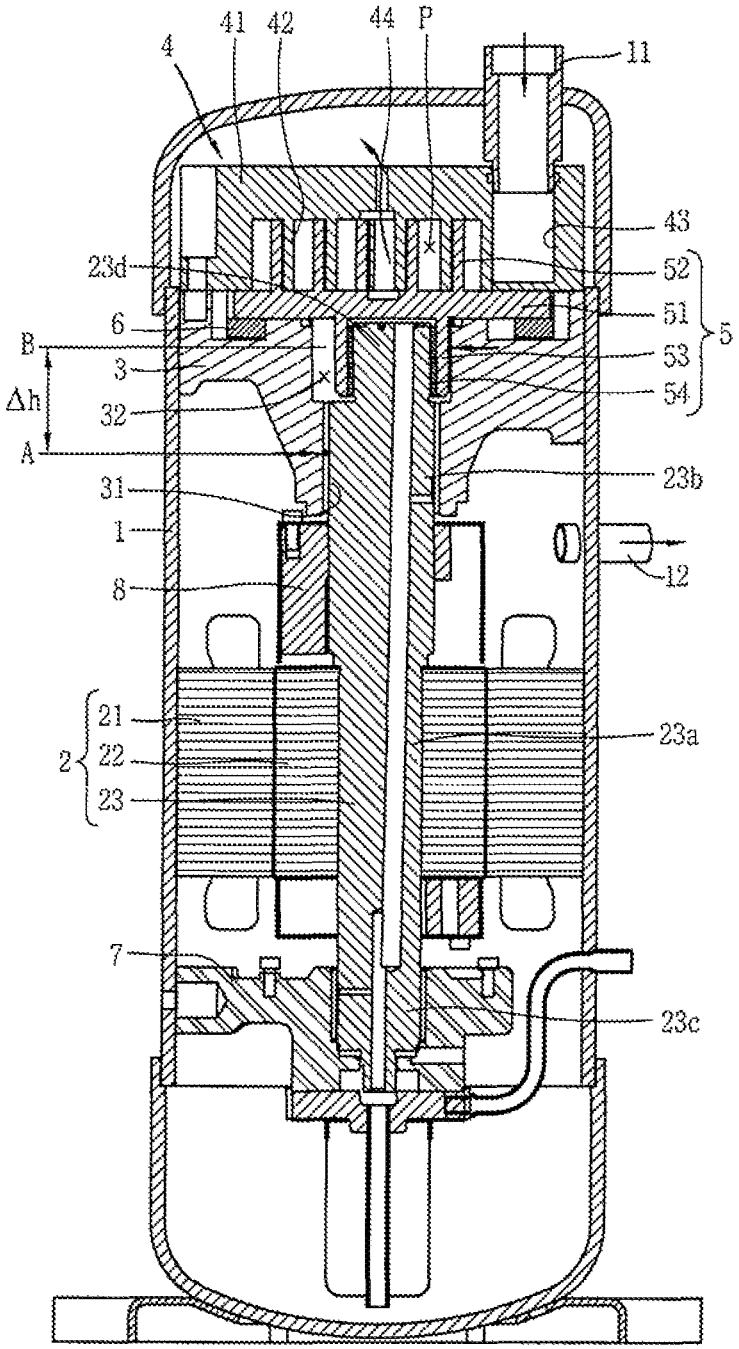
FIG. 1 RELATED ART
FIG. 1 is a cross-sectional view of an exemplary scroll compressor.
Figure 2:
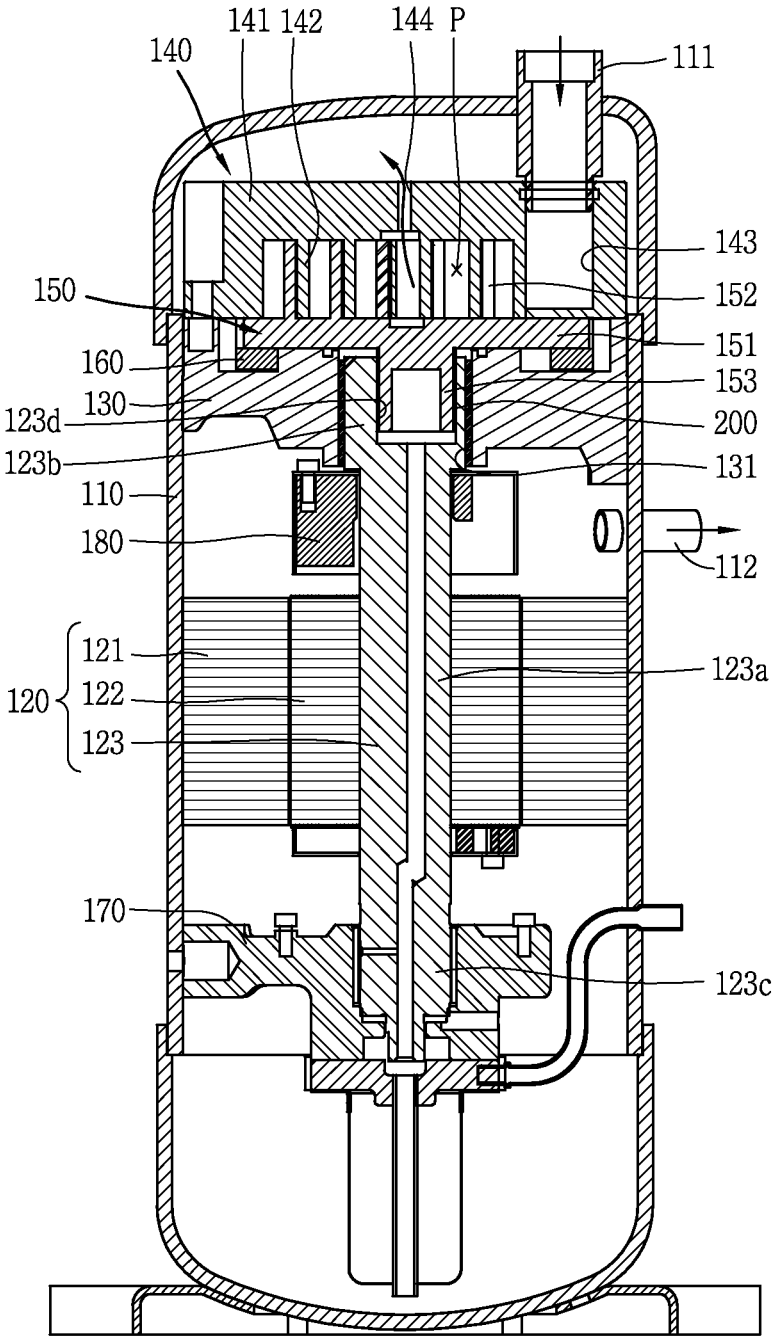
FIG. 2 is a cross-sectional view of a scroll compressor according to an embodiment as broadly described herein.
Figure 3:
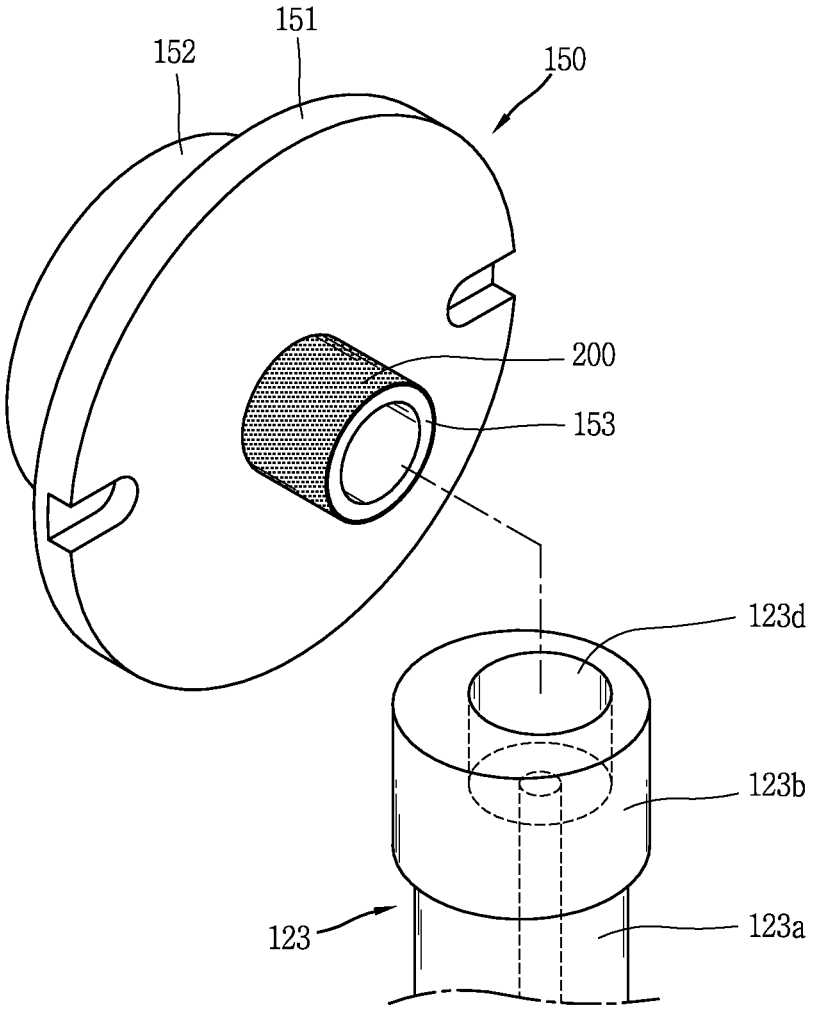
FIG. 3 is an exploded perspective view of an orbiting scroll and a crank shaft of the scroll compressor shown in FIG. 2.
Figure 4:
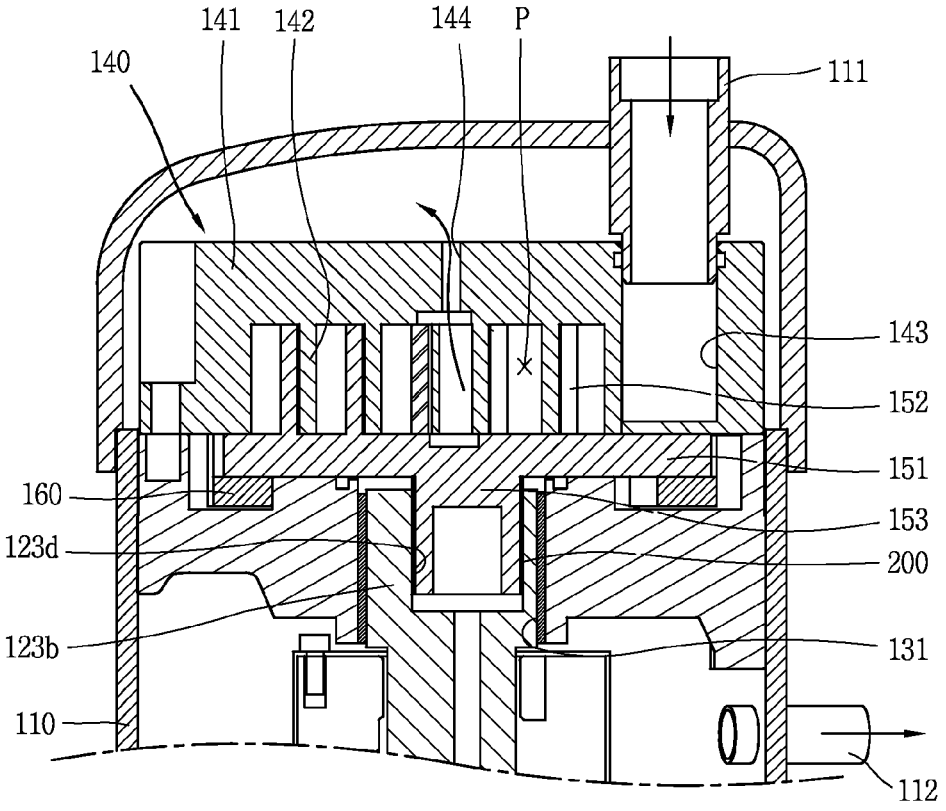
FIG. 4 is a cross-sectional view of a compression device of the scroll compressor device FIG. 2.

FIG. 1 is a cross-sectional view of an exemplary scroll compressor. As shown in FIG. 1, a scroll compressor may include a container 1, a driving motor 2 including a rotor 22 and a stator 21 installed in an inner space of the container 1 and generating rotary power, a main frame 3 fixed in the container 1, above the driving motor 2, a fixed scroll 4 installed on an upper surface of the main frame 3, an orbiting scroll 5 installed between the main frame 3 and the fixed scroll 4 and eccentrically coupled to a crank shaft 23 of the driving motor 2 to form a pair of compression chambers P continuously moving together with the fixed scroll 4, and an Oldham ring 6 installed between the fixed scroll 4 and the orbiting scroll 5 to prevent rotation of the orbiting scroll 5.

The main frame 3 is coupled to an inner circumferential surface of the container 1. A bearing hole 31 is formed at the center of the main frame 3, penetrating the main frame 3. A pocket recess 32 is formed at an upper end of the bearing hole 31 to allow a boss portion 53 of the orbiting scroll 5 to be inserted such that the boss portion is orbitable.

A fixed wrap 42 is formed on a lower surface of a disk plate 41 of the fixed scroll 4, a suction opening 43 is formed in one side of the disk plate 41 of the fixed scroll 4, and a discharge opening 44 is formed in the center of the fixed scroll 4.

An orbiting wrap 52 is formed on an upper surface of a disk plate 51 of the orbiting scroll 5 and engaged with the fixed wrap 42 of the fixed scroll 4 to form the compression chamber P. The boss portion 53 is formed on a lower surface of the disk plate 51 of the orbiting scroll 5 and coupled to the crank shaft 23. A bush bearing 54 is inserted into an inner circumferential surface of the boss portion 53 such that the bush bearing 54 is coupled with a pin 23*d* of the crank shaft 23.

The crank shaft 23 includes a shaft 23*a* press-fit to a rotor 22 of the driving motor 2, a main bearing portion 23*b* and a sub-bearing portion 23*c* respectively provided at upper and lower ends of the shaft 23*a* and supported by the main frame 3 and a sub-frame 7, with the pin 23*d* eccentrically formed at an upper end portion of the main bearing portion 23*b* shaft 23*a* and coupled to the bush bearing 54 inserted in the boss portion 53 of the orbiting scroll 5. An eccentric mass 8 is coupled to the main bearing portion 23*b* or the shaft 23*a* to cancel out an eccentric load generated while the orbiting scroll 5 performs an orbiting motion.

A suction pipe and a discharge pipe 12 extend through an outer wall of the container 1.

In the scroll compressor shown in FIG. 1, when power is applied to the driving motor 2 to generate rotary power, the orbiting scroll 5 performs an orbiting motion with respect to the fixed scroll 4 by the crank shaft 23 coupled to the rotor 22 of the driving motor 2, forming a pair of compression chambers P to suction, compress, and discharge refrigerant.

In this case, behavior of the orbiting scroll 5 may be unstable due to centrifugal force produced as a result of the orbiting movement, gas force produced as the refrigerant is compressed, and gas repulsive force in a direction opposite the centrifugal force applied thereto, but the orbiting scroll 5 supported by the main frame 3 may be appropriately adjusted to continue to make an orbiting movement.

However, in the scroll compressor shown in FIG. 1, an eccentric load is applied to the crank shaft 23 due to a height difference ($\Delta h$) made between a point of support A at which the crank shaft 23 is supported by the main frame 3 and a point of operation B at which the crank shaft 23 acts on the orbiting scroll 5, increasing a bearing load due to gas force and degrading compression efficiency due to frictional loss. In addition, acting force at a welding point is high due to gas force, increasing noise of the compressor and degrading reliability.

Also, since the crank shaft 23 is subjected to a large eccentric load, a weight of the eccentric mass 8 installed in the crank shaft 23 is increased, thus increasing cost, deformation of the crank shaft 23 is increased, thus degrading compression efficiency due to friction loss, centrifugal force of the eccentric mass 8 is increased, thus increasing acting force at a welding point, increasing noise of the compressor and degrading reliability.

Also, since the bearing hole 31 of the main frame 3 supporting the crank shaft 23 and the pocket recess 32 in which the boss portion 53 of the orbiting scroll 5 is inserted are spaced apart by a predetermined gap, a length of the main bearing portion 23*b* of the crank shaft 23 is increased and the crank shaft 23 is subjected to a large eccentric load 8, increasing a size of the main frame 3, which may increase a length of the compressor in an axial direction, an increase in material costs, and a limitation in a lamination height of the motor.

As shown in FIGS. 2-7, in a scroll compressor as embodied and broadly described herein, a driving motor 120 including a rotor 122 and a stator 121 generating rotary power may be installed in an inner space of a container 110, and a main frame 130 may be installed in the container 110, above the driving motor 120. A fixed scroll 140 is installed on an upper surface of the main frame 130, and an orbiting scroll 150 is installed between the main frame 103 and the fixed scroll 140. The orbiting scroll 150 may be eccentrically coupled to a crank shaft 123 of the driving motor 120 to form a pair of compression chambers P continuously moving together with the fixed scroll 140. An Oldham ring 160 may be installed between the fixed scroll 140 and the orbiting scroll 150 to prevent rotation of the orbiting scroll 150.

The main frame 130 may be coupled to an inner circumferential surface of the container 110, and a bearing hole 131 may be formed in the center of the main frame 130, penetrating main frame 130. The bearing hole 131 may have a uniform diameter from an upper end of the bearing hole 131 to a lower end thereof.

The fixed scroll 140 may include a fixed wrap 142 that protrudes from a lower surface of a disk plate 141 to form the compression chamber P together with an orbiting wrap 152 of the orbiting scroll 150, and a suction opening 143 may be formed in the disk plate 141 of the fixed scroll 140 and communicate with the compression chamber P together with the orbiting wrap 152.

A discharge opening 144 may be formed at the center of the disk plate 141 of the fixed scroll 140 to allow the compression chamber P and an inner space of the container 110 to communicate with each other, and a check valve (not shown) may be installed in an end portion of the discharge opening 144 to open the discharge opening 144 when the compressor is normally operated and close the discharge opening 144 when the compressor is stopped to prevent a discharged refrigerant to flow backward to the compression chamber P.

In the orbiting scroll 150, the orbiting wrap 152 may protrude from an upper surface of a disk plate 151 and be engaged with the fixed wrap 142 of the fixed scroll 140 to form the pair of compression chambers P, and a boss portion 153 may be formed on a lower surface of the disk plate 151 of the orbiting scroll 150 and inserted into a boss coupling recess 123*d* of the crank shaft 123 to receive rotary power.

The boss portion 153 may be formed at a geometric center of the orbiting scroll 150. The boss portion 153 may be formed as a solid bar shape or may be formed as a hollow cylindrical shape in order to reduce the weight of the orbiting scroll 150.

The crank shaft 123 may include a shaft 123*a* press-fit to a rotor 122 of the driving motor 120, a main bearing portion 123*b* and a sub-bearing portion 123*c* respectively provided at upper and lower ends of the shaft 123*a* and supported by the main frame 130 and a sub-frame 170. The boss coupling recess 123*d* may be eccentrically formed at the upper end portion of the main bearing portion 123*b*, allowing the boss portion 153 of the orbiting scroll 150 to be insertedly coupled thereto.

An eccentric mass 180 may be coupled to the main bearing portion 123*b* or the shaft 123*a* to cancel out or balance an eccentric load generated while the orbiting scroll 10 makes an orbiting movement.

Figure 5:
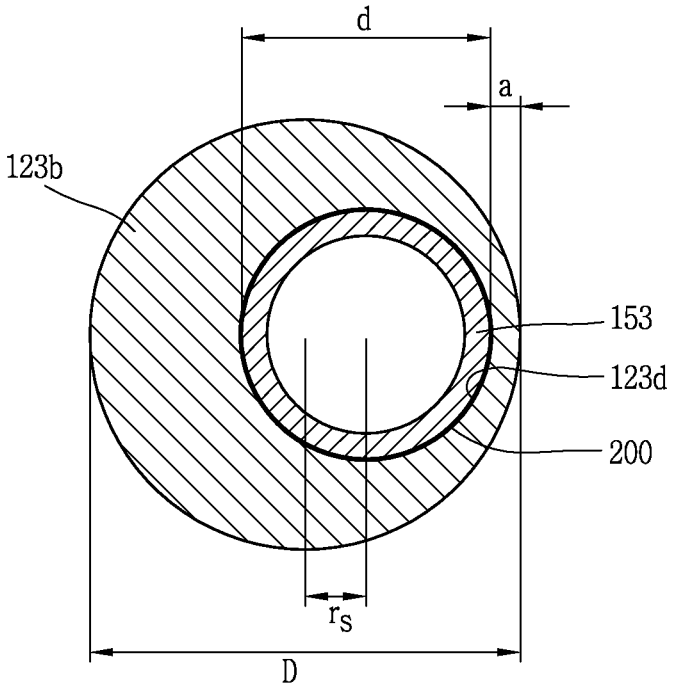
FIGS. 5 and 6 are a cross-sectional view taken along line I-I of FIG. 4 illustrating a minimum thickness of a boss coupling recess of the scroll compressor shown in FIG. 4 and an exploded cross-sectional view of the orbiting scroll and the crank shaft.
Figure 6:
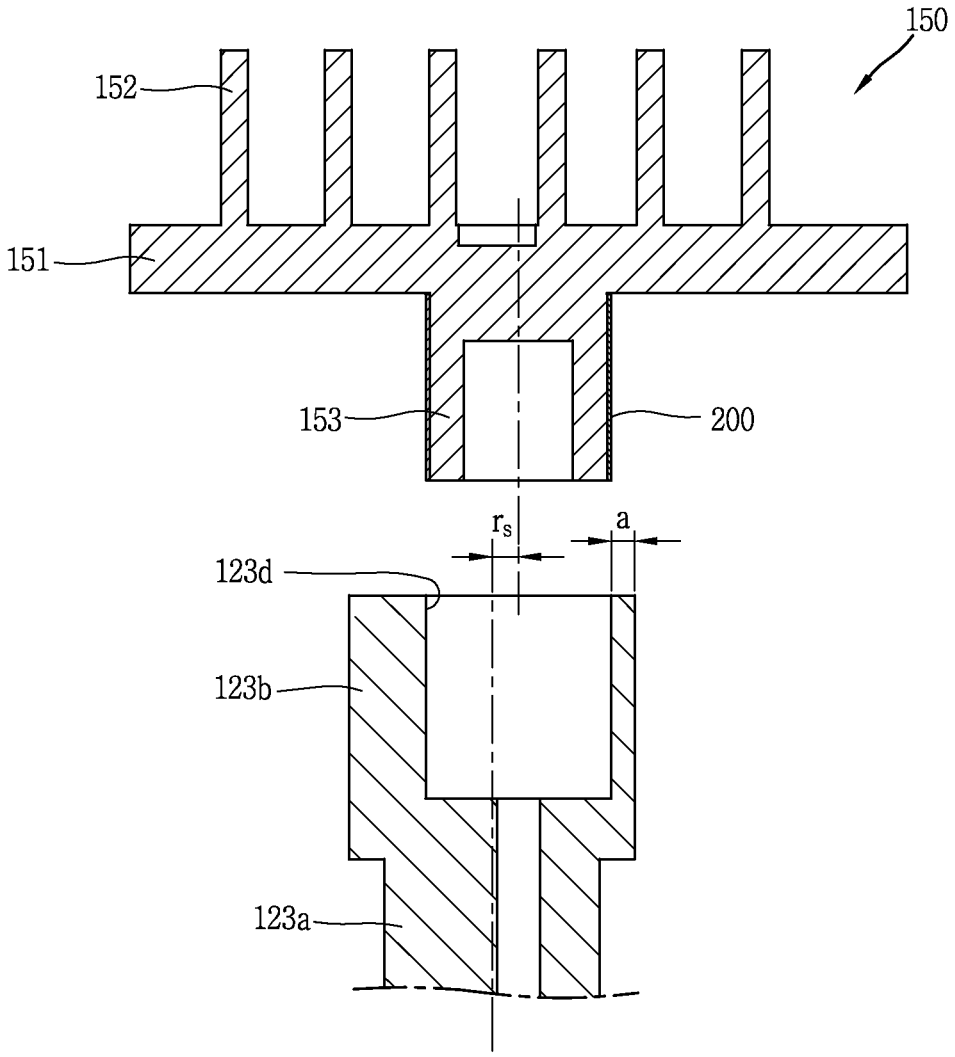

As illustrated in FIGS. 5 and 6, a sectional area of the main bearing portion 123*b* is larger than that of the shaft 123*a*, and the boss coupling recess 123*d* may be eccentric to one side from an upper surface of the main bearing portion 123*b*. An outer diameter D of the main bearing portion 123*b* may be determined by a minimum gap (a) from an outer circumferential surface to an inner circumferential surface of the boss coupling recess 123*d*.

For example, when an outer diameter of the main bearing portion 123*b* is D, an outer diameter of the boss portion 153 of the orbiting scroll 150 is d, and eccentricity of the boss coupling recess 123*d* is rs, the minimum gap (a) may be $a=(D-d)/2-rs$.

Here, if the diameter of the main bearing portion 123*b* is small, the minimum gap (a) may be excessively thin, degrading reliability of the main bearing portion 123*b*. Conversely, when the diameter of the main bearing portion 123*b* is large, the minimum gap (a) may be sufficiently secured, increasing reliability of the main bearing portion 123*b*, but a bearing area may increase, increasing friction loss. Thus, a minimum gap for securing reliability of the main bearing portion 123*b* and minimizing friction loss may be appropriately maintained. To this end, the minimum gap (a) may be within a range of $d/20<a<d/4$.

A bush bearing 200 may be installed between the boss portion 153 of the orbiting scroll 150 and the boss coupling recess 123*d* of the crank shaft 123.

The bush bearing 200 may be formed on an inner circumferential surface of the boss coupling recess 123*d*. Alternatively, as illustrated in FIGS. 2 through 7, the bush bearing 200 may be formed on an outer circumferential surface of the boss portion 153 to prevent abrasion of the bush bearing 200.

Figure 7:
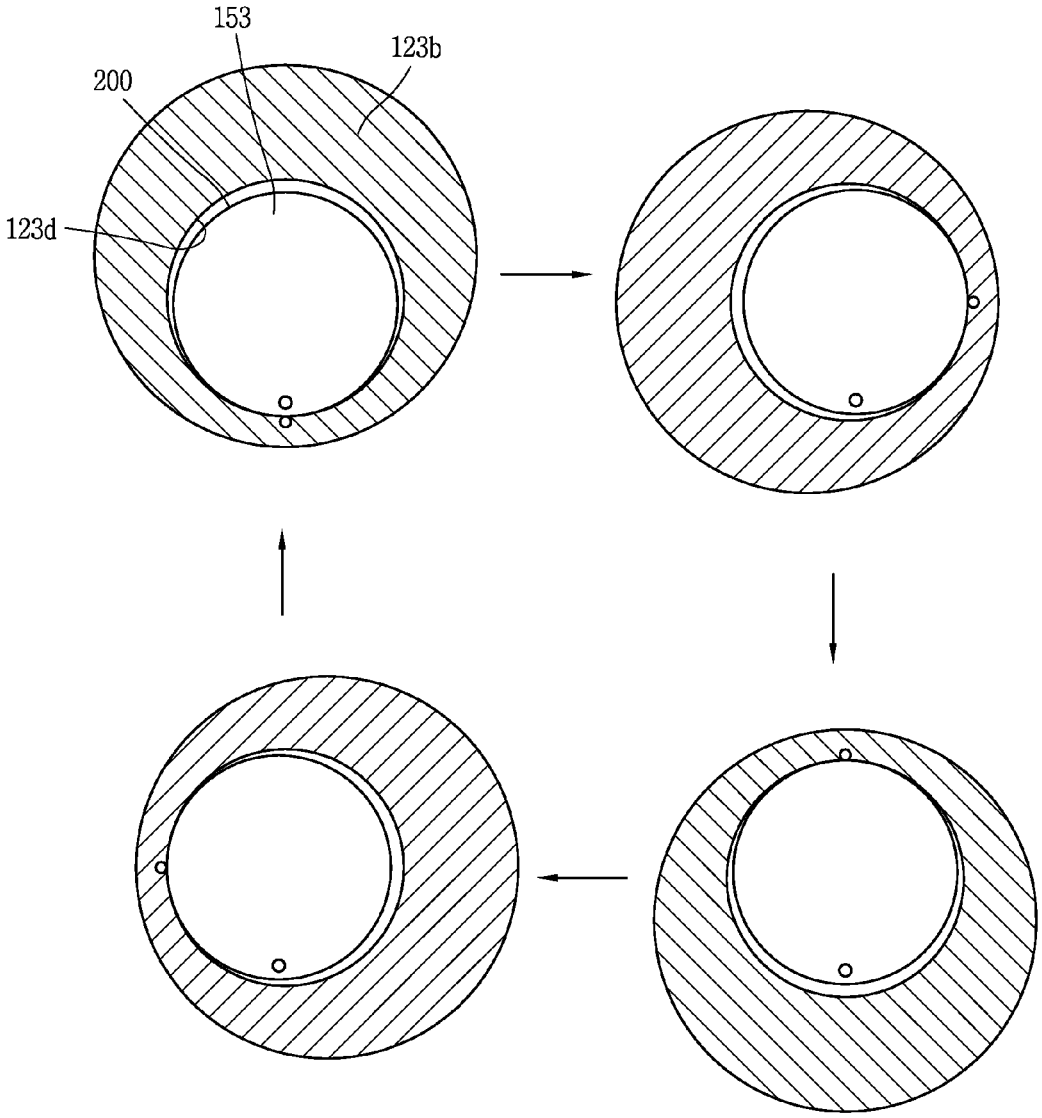
FIG. 7 is a plan view illustrating contact relationships between a boss portion and a boss coupling recess of the scroll compressor shown in FIG. 4.

FIG. 7 is a schematic view illustrating that abrasion of the bush bearing may be reduced when the bush bearing is formed in the boss portion. As illustrated in FIG. 7, in a case in which the boss portion 153 of the orbiting scroll 150 is inserted into the boss coupling recess 123*d* of the crank shaft 123, one point of an inner circumferential surface of the boss coupling recess 123*d* is in contact with the entirety of the outer circumferential surface of the boss portion 153. In other words, the entirety of the outer circumferential surface of the boss portion 153 is in contact with one point of the inner circumferential surface of the boss coupling recess 123*d*. Thus, the outer circumferential surface of the boss portion 153 is evenly in contact with the inner circumferential surface of the boss coupling recess 123*d*, rather than that any one point of the outer circumferential surface of the boss portion 153 being in concentrated contact with the inner circumferential surface of the boss coupling recess 123*d*, and thus abrasion of the boss portion 153 may be prevented or decreased. However, in the case of the boss coupling recess

123*d*, since only one point of the boss coupling recess 123*d* is in contact with the outer circumferential surface of the boss portion 153, the one point of the boss coupling recess 123*d* in contact with the boss portion 153 may be abraded in a concentrated manner.

Thus, in a case in which the bush bearing 200 is installed on the boss coupling recess 123*d*, one point of the bush bearing 200 may be abraded in a concentrated manner, degrading reliability. Thus, instead, the bush bearing 200 may be installed on the outer circumferential surface of the boss portion 153 so as to be prevented damage.

As illustrated in FIGS. 2 through 6, the bush bearing 200 may be formed of a self-lubricating material. That is, the bush bearing 200 may be formed by, for example, coating an engineering plastic material, having ether ketone linkage such as PEEK, in a predetermined thickness on an outer circumferential surface of the boss portion 153. In this case, the thickness of the bush bearing 200 may be minimized. Also, when the bush bearing 200 is relatively thin, an outer diameter of the main bearing 130 may be reduced, reducing friction loss and weight of the crank shaft 123, to enhance motor efficiency.

In a scroll compressor in accordance with the embodiment shown in FIGS. 2-7, when power is applied to the driving motor 120 to generate rotary power, the orbiting scroll 150 eccentrically coupled to the crank shaft 123 makes an orbiting movement to form a pair of compression chambers P continuously moving between the orbiting scroll 150 and the fixed scroll 140. The compression chambers P are continuously formed in several stages such that a volume thereof is gradually reduced in a direction from the suction opening (or the suction chamber) 143 to the discharge opening (or the discharge chamber) 144.

Then, refrigerant provided from the outside of the container 110 through a suction pipe 111 is introduced through the suction opening 143 of the fixed scroll 140, compressed as it moves toward a final compression chamber by the orbiting scroll 150, and is discharged to an inner space of the container 110 through the discharge opening 144 of the fixed scroll 140 from the final compression chamber. These sequential processes are repeatedly performed.

Figure 8:
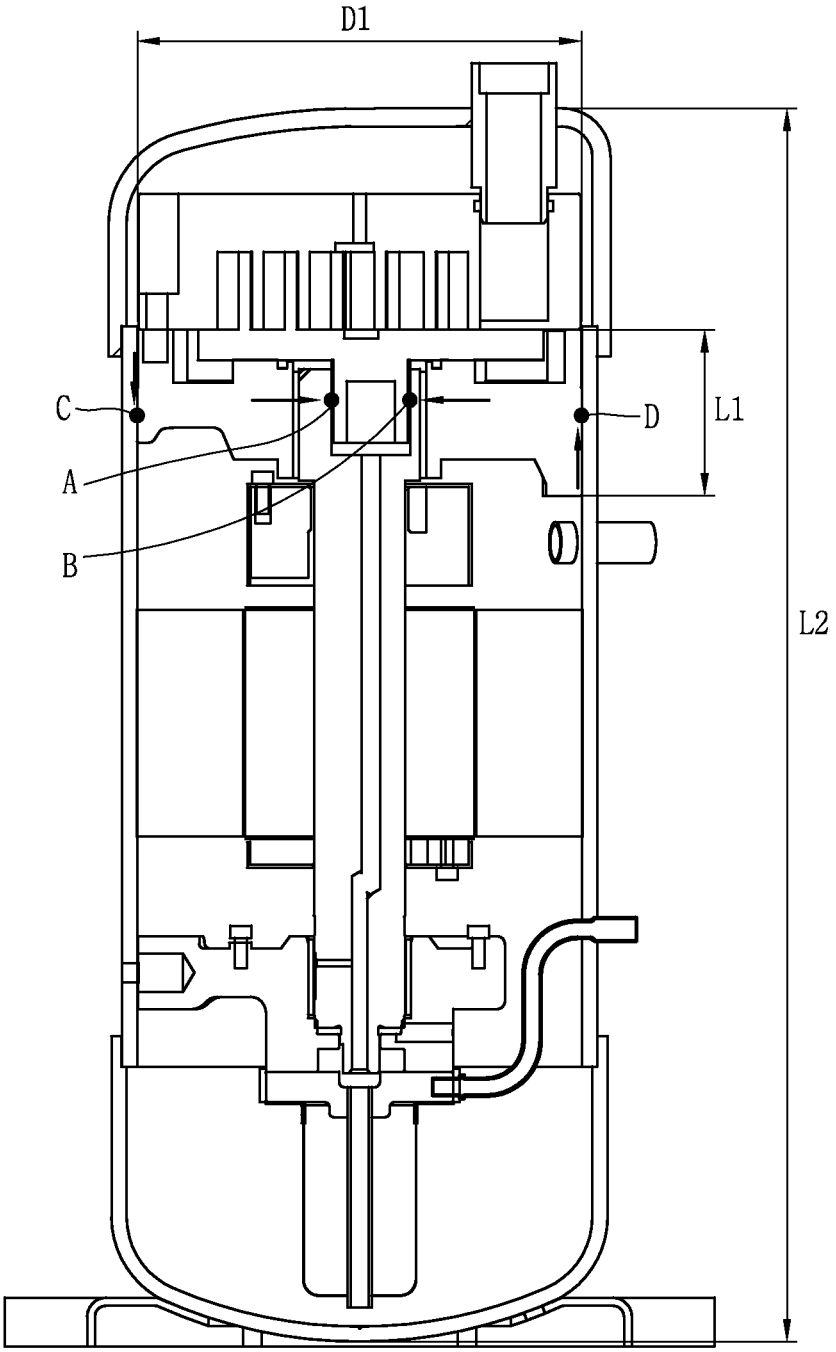
FIG. 8 is a schematic view illustrating dimensions of portions of the scroll compressor shown in FIG. 2.

Here, as illustrated in FIG. 8, as the boss portion 153 of the orbiting scroll 150 is inserted into and coupled to the boss coupling recess 123*d* of the crank shaft 123, a height difference ($\Delta h=0$) between a point A of support at which the crank shaft 123 is supported by the main frame 130 and a point B of application (or a point of action) at which the crank shaft 123 acts on the orbiting scroll 150 may be eliminated, thus reducing an eccentric load exerted on the crank shaft 123, whereby friction loss of the main bearing portion 123*b* may be reduced to enhance compression efficiency. In addition, acting force exerted on welding points C and D between the container 110 and the main frame 130 may be reduced, reducing compressor noise and enhancing reliability.

Also, since the eccentric load exerted on the crank shaft 123 is reduced, a weight and material cost of the eccentric mass 180 installed in the crank shaft 123 may be reduced and deformation of the crank shaft 123 may be reduced, enhancing compression efficiency. In addition, acting force on the welding points C and D between the container 110 and the main frame 130 may be reduced due to centrifugal force of the eccentric mass 180, reducing compressor noise and enhancing reliability.

Also, the main frame 130 does not need a pocket recess, reducing a length L and a diameter D1 of the main frame 130, thus reducing material costs, and reducing a length L2 of the compressor in an axial direction, thus increasing a lamination height of the motor.

In addition, since the bush bearing 200 is formed on the boss portion 153 of the orbiting scroll 150, the entire outer circumferential surface of the bush bearing 200 may be in contact with one point of the inner circumferential surface of the boss coupling recess 123*d*, whereby one point of the bush bearing 200 may be prevented from being in concentrated contact, and thus, damage to the bush bearing 200 may be prevented.

Another example of a bush bearing for a scroll compressor, according to embodiments as broadly described herein, will be described as follows.

Figure 9:
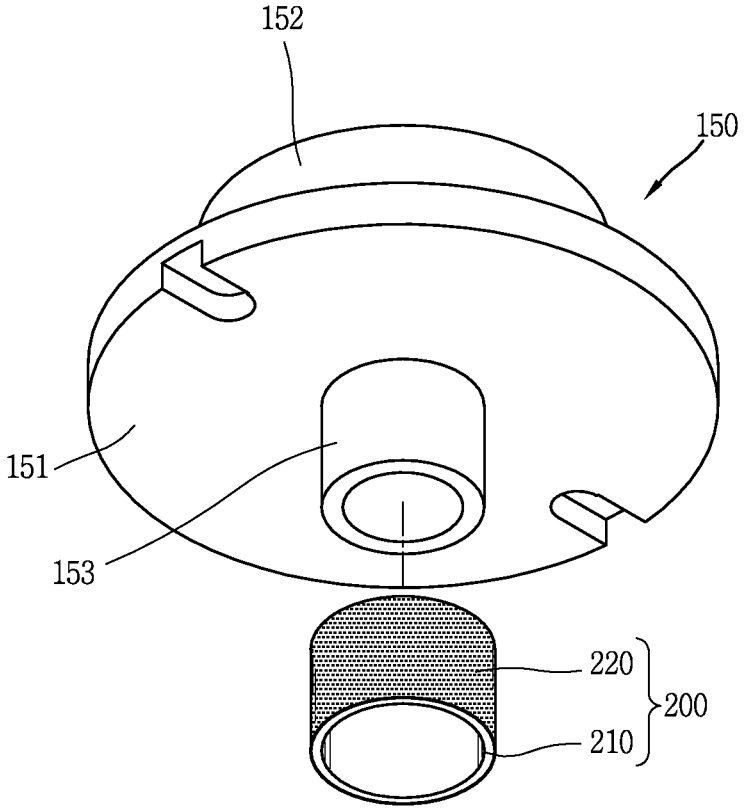
FIGS. 9 and 10 are perspective views of a bush bearing of the scroll compressor, according to an embodiment as broadly described herein.

In the embodiment described above, the bush bearing is formed by coating a self-lubricating material on the outer circumferential surface of the boss portion. In contrast, in the embodiment shown in FIG. 9, the bush bearing 200 includes a fixed bush 210 having elasticity and a lubricating bush 220 formed of a self-lubricating material coated on or attached to an outer circumferential surface of the fixed bush 210. The fixed bush 210 may be formed of, for example, a metal having relatively high stiffness, while the lubricating bush 220 may be formed of, for example, an engineering plastic material having ether ketone linkage such as PEEK (polyether ether ketone) having self-lubricating properties, although stiffness thereof may be relatively low.

A basic configuration and operational effects of this arrangement are similar to those of the previous embodiment described above. However, in this embodiment, a thickness of the bearing portion may be greater than that of the previous embodiment. However, since stiffness of the bearing portion is increased, reliability thereof may be enhanced.

Figure 10:
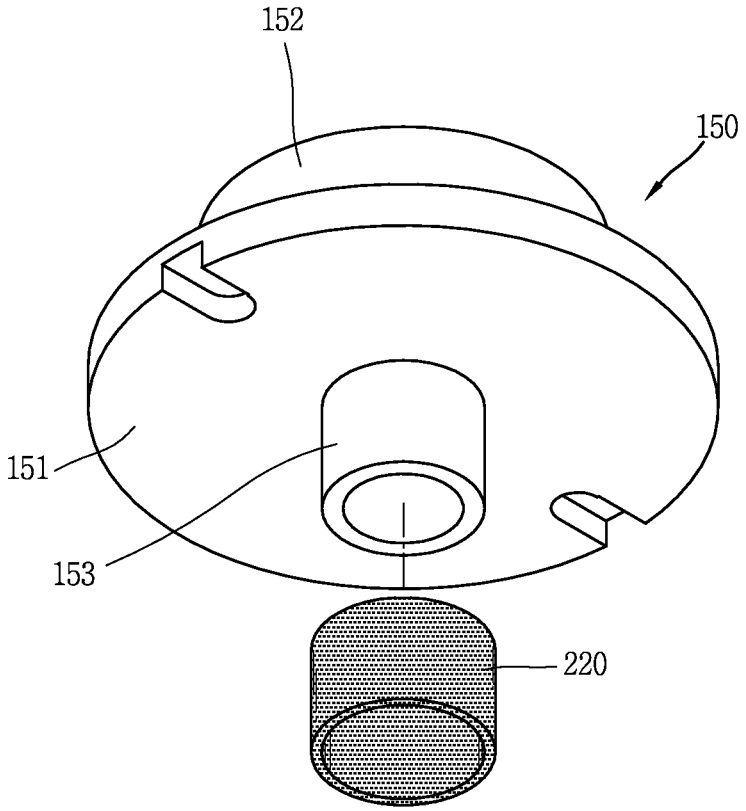

In a scroll compressor as embodied and broadly described herein, as illustrated in FIG. 10, another example of the bush bearing is formed as a single member, has a bush shape, and is formed of a self-lubricating material. The bush bearing is press-fit to be coupled to the boss portion 153 of the orbiting scroll 150.

In this embodiment, a basic configuration and operational effects are similar to those of the previous embodiment described above. However, in this embodiment, since the bush bearing 200 is formed of an engineering plastic material having an ether ketone linkage such as PEEK having self-lubricating properties, a thickness of the bush bearing 200 is not significantly increased and a predetermined extra thickness may be secured, relative to the case of forming the bush bearing 200 through coating, whereby damage to the bush bearing 200 due to abrasion may be alleviated.

A scroll compressor is provided in which a height difference between a point of support at which a crank shaft is supported by a main frame and a point of application at which the crank shaft acts on an orbiting scroll is eliminated or reduced to reduce an eccentric load applied to the crank shaft to thus reduce friction loss of a bearing to improve compression efficiency, and acting force at a welding point is reduced to reduce noise of the compressor and enhance reliability.

A scroll compressor is provided in which an eccentric load applied to a crank shaft is reduced to reduce a weight of an eccentric mass installed in the crank shaft and material cost, deformation of the crank shaft is reduced to enhance compression efficiency, and acting force at a welding point due to centrifugal force of the eccentric mass is also reduced to reduce compressor noise and enhance reliability.

A scroll compressor is provided in which a length and size of a main frame are reduced to reduce material cost and a length of the compressor in an axial direction is reduced to increase a lamination height of a motor.

A scroll compressor, as embodied and broadly described herein, may include a container; a frame coupled to the container and having a bearing hole formed therein; a fixed scroll coupled to the frame and having a fixed wrap formed therein; an orbiting scroll supported by the frame and including an orbiting wrap engaged with the fixed wrap to form continuously moving compression chambers and a boss portion protruded toward the bearing hole to receive rotary power from a driving motor; and a crank shaft, to which the boss portion of the orbiting scroll is coupled, configured to transfer rotary power from the driving motor to the orbiting scroll, wherein a boss coupling recess is formed in the crank shaft such that the boss portion of the orbiting scroll is inserted into the boss coupling recess, and a bush bearing is provided on an outer circumferential surface of the boss portion and forms a bearing surface with an inner circumferential surface of the boss coupling recess.

The boss coupling recess may be formed to be eccentric with respect to a central axis.

Based on a diameter (d) of the boss portion of the orbiting scroll, a minimum gap (a) from an outer circumferential surface of the bush bearing to an inner circumferential surface of the boss coupling recess may be within a range of $/20<a<d/4$.

The bush bearing may be coated to be formed on the boss portion.

The bush bearing may be formed of a self-lubricative material.

The bush bearing may be press-fit to be coupled to the boss portion.

The bush bearing may be formed as a single member having self-lubricativeness.

The bush bearing may have an annular cross-sectional shape.

The bush bearing may include a fixed bush having an annular cross-sectional shape and a lubricating bush formed on an outer circumferential surface of the fixed bush, wherein the fixed bush may be formed of a material having high stiffness relative to that of the lubricating bush.

The lubricating bush may be formed of a plastic material having self-lubricativeness.

At least a portion of the bush bearing may be formed of a plastic material having an ether ketone linkage.

A bearing portion may be formed in the crank shaft and inserted into the bearing hole of the frame so as to be supported in a radial direction, and the boss coupling recess may be formed in the bearing portion.

A scroll compressor, as embodied and broadly described herein, may include a fixed scroll having a fixed wrap formed therein; an orbiting scroll having an orbiting wrap engaged with the fixed wrap to form continuously moving compression chambers and including a boss portion to receive rotary power from a driving motor; and a crank shaft having a boss coupling recess to which the boss portion of the orbiting scroll is coupled, the boss coupling recess eccentrically formed with respect to a central axis, wherein a bush bearing is coupled to an outer circumferential surface of the boss portion and the bush bearing has an annular cross-sectional shape.

Based on a diameter (d) of the boss portion of the orbiting scroll, a minimum gap (a) from an outer circumferential surface of the bush bearing to an inner circumferential surface of the boss coupling recess may be within a range of $d/20<a<d/4$.

The bush bearing may be formed as a single member having self-lubricativeness.

The bush bearing may include a fixed bush having an annular cross-sectional shape and a lubricating bush formed on an outer circumferential surface of the fixed bush, wherein the fixed bush may be formed of a material having high stiffness relative to that of the lubricating bush.

The lubricating bush may be formed of a plastic material having self-lubricativeness.

At least a portion of the bush bearing may be formed of a plastic material having an ether ketone linkage.

In a scroll compressor as embodied and broadly described herein, since the boss portion of the orbiting scroll is inserted into and coupled to the boss coupling recess of the crank shaft, an eccentric load exerted on the crank shaft is reduced to reduce friction loss of the bearing portion, enhancing compression efficiency and reliability and reducing noise. Also, a weight and material cost of the eccentric mass may be reduced and deformation of the crank shaft is reduced, enhancing compression efficiency.

Also, since the main frame does not need a pocket recess, a length L and a diameter of the main frame may be reduced to reduce material costs and reduce a length of the compressor in an axial direction to increase a lamination height of the motor.

In addition, since the bush bearing is coated to be formed on the boss portion of the orbiting scroll, the outer circumferential surface of the bush bearing may be in contact with the entirety of the inner circumferential surface of the boss coupling recess, whereby the bush bearing may be prevented from being concentratively brought into contact with one point of the inner circumferential surface of the boss coupling recess, and thus, damage to the bush bearing may be prevented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a container;

a frame coupled to the container and having a bearing hole formed therein;

a fixed scroll coupled to the frame, the fixed scroll including a fixed wrap provided on a fixed plate;

an orbiting scroll supported by the frame, the orbiting scroll including:

an orbiting wrap provided on an orbiting plate, the orbiting wrap engaged with the fixed wrap so as to form a plurality of continuously moving compression chambers therebetween; and a boss that protrudes from the orbiting plate into the bearing hole formed in the frame; and a crank shaft coupled to the boss of the orbiting scroll and to a driving motor provided in the container so as to transfer rotary power from the driving motor to the orbiting scroll, wherein the crank shaft includes:

a boss coupling recess formed at an upper end thereof such that the boss of the orbiting scroll is inserted into the boss coupling recess; and a bush bearing provided on an outer circumferential surface of the boss, wherein the bush bearing forms a bearing surface with an inner circumferential surface of the boss coupling recess, wherein the boss coupling recess is eccentric with respect to a central axis of the crank shaft, and wherein a minimum gap (a) from an outer circumferential surface of the bush bearing to the inner circumferential surface of the boss coupling recess is within a range of $d/20<a<d/4$, where (d) is a diameter of the boss of the orbiting scroll.

2. The scroll compressor of claim 1, wherein the bush bearing is coated on the boss of the orbiting scroll.

3. The scroll compressor of claim 2, wherein the bush bearing includes a self-lubricating material.

4. The scroll compressor of claim 1, wherein the hush bearing is press-fitted on the boss of the orbiting scroll.

5. The scroll compressor of claim 4, wherein the bush bearing is formed as a single unit having self-lubricating properties.

6. The scroll compressor of claim 5, wherein the bush bearing has an annular cross-sectional shape.

7. The scroll compressor of claim 4, wherein the bush bearing includes:

a fixed bushing having an annular cross-sectional shape; and a lubricating bushing press-fitted on an outer circumferential surface of the fixed bushing, and wherein of the fixed bushing is greater than a stiffness of the lubricating bushing.

8. The scroll compressor of claim 7, wherein the lubricating bushing is formed of a plastic material having self-lubricating properties.

9. The scroll compressor of claim 1, wherein at least a portion of the bush heating is formed of a plastic material having an ether ketone linkage.

10. The scroll compressor of claim 1, further including a bearing portion formed in the crank shaft and inserted into the bearing hole formed in the frame so as to be supported in a radial direction, wherein the boss coupling recess is formed in the bearing portion of the crank shaft.

11. A scroll compressor, comprising:

a fixed scroll including a fixed wrap formed on a fixed plate;

an orbiting scroll including:

an orbiting wrap formed on a first side of an orbiting plate, the orbiting wrap engaged with the fixed wrap to form a plurality of continuously moving compression chambers; and a boss formed on a second side of the orbiting plate opposite the first side thereof;

a crank shaft having a first end coupled to a driving motor and a second end having a boss coupling recess to which the boss of the orbiting scroll is coupled, wherein the boss coupling recess is formed eccentric with respect to a central axis of the crank shaft; and a bush bearing coupled to an outer circumferential surface of the boss of the orbiting scroll, the bush beating having an annular cross-sectional shape, wherein a minimum gap (a) from an outer circumferential surface of the bush bearing to an inner circumferential surface of the boss coupling recess is within a range of $d/20<a<d/4$, where (d) is a diameter of the boss of the orbiting scroll.

12. The scroll compressor of claim 11, wherein the bush bearing is formed as a single unit having self-lubricating properties.

13. The scroll compressor of claim 11, wherein the bush bearing includes:

a fixed bushing having an annular cross-sectional shape; and a lubricating bushing press-fitted on an outer circumferential surface of the fixed bushing, and wherein a stiffness of the fixed bushing is greater than a stiffness of the lubricating bushing.

14. The scroll compressor of claim 13, wherein the lubricating bushing is formed of a plastic material having self-lubricating properties.

15. The scroll compressor of claim 11, wherein at least a portion of the bush hearing is formed of a plastic material having an ether ketone linkage.

16. The scroll compressor of claim 11, wherein the bush bearing is press-fitted on the boss of the orbiting scroll.

17. A scroll compressor, comprising:

a fixed scroll including a fixed wrap formed on a fixed plate;

an orbiting scroll including:

an orbiting wrap formed on a first side of an orbiting plate, the orbiting wrap engaged with the fixed wrap to form a plurality of continuously moving compression chambers; and a boss formed on a second side of the orbiting plate opposite the first side thereof;

a crank shaft having a first end coupled to a driving motor and a second end having a boss coupling recess to which the boss of the orbiting scroll is coupled, wherein the boss coupling recess is formed eccentric with respect to a central axis of the crank shaft; and a bush bearing coupled to an outer circumferential surface of the boss of the orbiting scroll, the bush bearing having an annular cross-sectional shape, wherein a minimum gap (a) from an outer circumferential surface of the bush bearing to an inner circumferential surface of the boss coupling recess is within a range of $d/20<a<d/4$, where (d) is a diameter of the boss of the orbiting scroll, and wherein the bush bearing is press-fitted on the boss of the orbiting scroll.

18. The scroll compressor of claim 17, wherein the bush bearing is formed as a single unit having self-lubricating properties.

19. The scroll compressor of claim 17, wherein the bush bearing includes:

a fixed bushing having an annular cross-sectional shape; and a lubricating bushing press-fitted on an outer circumferential surface of the fixed bushing, and wherein a stiffness of the fixed bushing is greater than a stiffness of the lubricating bushing.

* * * * *